US008651791B2

(12) United States Patent
Thiessen

(10) Patent No.: US 8,651,791 B2
(45) Date of Patent: Feb. 18, 2014

(54) GRAIN BIN DOOR ASSEMBLY WITH EXTERIOR CHUTE

(76) Inventor: Lester James Thiessen, Neilburg (CA)

( * ) Notice: Subject to any disclaimer, the term of this patent is extended or adjusted under 35 U.S.C. 154(b) by 376 days.

(21) Appl. No.: 12/974,143

(22) Filed: Dec. 21, 2010

(65) Prior Publication Data

US 2011/0280704 A1 Nov. 17, 2011

Related U.S. Application Data

(60) Provisional application No. 61/334,343, filed on May 13, 2010.

(51) Int. Cl.
*B65G 65/00* (2006.01)

(52) U.S. Cl.
USPC ..... 414/292; 49/70

(58) Field of Classification Search
USPC ..... 414/288, 292, 304, 305, 306, 308, 309, 414/310, 325, 326, 324; 222/412, 413, 531, 222/532, 533; 49/38, 39, 42, 69, 104, 146, 49/163, 371; 160/370.1; 193/32; 221/174
See application file for complete search history.

(56) References Cited

U.S. PATENT DOCUMENTS

| | | | | | |
|---|---|---|---|---|---|
| 935,096 | A * | 9/1909 | Eaton | 222/533 |
| 1,744,407 | A * | 1/1930 | Meccia et al. | 414/288 |
| 1,782,675 | A * | 11/1930 | Bayley | 52/192 |
| 2,799,431 | A * | 7/1957 | Bush et al. | 222/108 |
| 3,072,290 | A * | 1/1963 | De Biasi | 222/23 |
| 3,095,073 | A * | 6/1963 | Larson et al. | 193/33 |
| 4,066,158 | A * | 1/1978 | Hare et al. | 193/34 |
| 4,278,163 | A * | 7/1981 | Tomich | 193/34 |
| 4,838,598 | A * | 6/1989 | Hyde | 296/50 |
| 4,881,782 | A * | 11/1989 | Gagner | 298/7 |
| 5,255,769 | A * | 10/1993 | Echelberger | 193/4 |
| 5,647,471 | A * | 7/1997 | Ra | 194/350 |
| 6,349,859 | B1 * | 2/2002 | Epp et al. | 222/533 |
| 7,350,636 | B2 * | 4/2008 | Smith et al. | 193/33 |
| 7,350,872 | B2 * | 4/2008 | Wood | 298/18 |
| 7,520,247 | B2 * | 4/2009 | Rutledge | 119/51.01 |

* cited by examiner

*Primary Examiner* — Saul Rodriguez
*Assistant Examiner* — Glenn Myers
(74) *Attorney, Agent, or Firm* — Ryan W. Dupuis; Kyle R. Satterthwaite; Ade & Company Inc.

(57) ABSTRACT

A door assembly for an agricultural storage bin includes an exterior chute communicating with a lower portion of a bin door opening. The exterior chute extends outwardly at an upward inclination from a bottom edge of the door opening to an open top end spaced below a top end of the door opening. An inner door panel hinged at an inner side of the bin wall spans an upper portion of the door opening above the exterior chute when closed. A cover member spans an open top end of the exterior chute when closed. An unloading auger can be readily inserted through the external chute below the inner door panel for unloading the bin by removing the cover member. The inner door can be subsequently opened inwardly when the level in the bin falls below the upper portion of the bin door opening.

19 Claims, 6 Drawing Sheets

GRAIN BIN DOOR ASSEMBLY WITH EXTERIOR CHUTE

This application claims the benefit under 35 U.S.C. 119(*e*) of U.S. provisional application Ser. No. 61/334,343, filed May 13, 2010.

FIELD OF THE INVENTION

The present invention relates to a door assembly for an agricultural storage bin, for example a grain bin, and more particularly relates to a grain bin door assembly which includes an exterior chute for providing access for inserting an unloading auger through the door opening of the bin.

BACKGROUND

Storage bins are commonly used for storing particulate material therein, for example grain and the like. Storage bins of this type generally have a circular bin floor with a cylindrical bin wall extending upwardly from the floor. Typically a door is provided spanning an inner side of a door opening in the bin wall to provide access to the bin when empty. Gates are known to be provided in the door panel or bin wall to provide access to unload the grain from one side of the bin. An external hopper is typically required in this instance to collect the grain spilling outwardly from the grain bin during unloading for collection by a suitable unloading auger.

U.S. Pat. No. 6,349,859 by Epp et al. discloses one example of an unloading chute to assist in unloading a storage bin in which the chute comprises chute walls formed integrally with a door panel to extend inwardly into the interior of the storage bin to provide access for a conventional unloading auger to be inserted into the chute for unloading the bin. The resulting construction of the chute protrudes into the bin and can therefore interfere with unloading equipment including sweep augers and the like which may be installed in the bin. The chute also occupies internal storage space inside the bin.

SUMMARY OF THE INVENTION

According to one aspect of the invention there is provided a door assembly for an agricultural storage bin comprising a circular bin floor, a cylindrical bin wall extending upwardly from the bin floor, and a door opening in the cylindrical bin wall, the door assembly comprising:

an exterior chute arranged to communicate with a lower portion of the door opening, the exterior chute including a bottom wall arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute at an inner side of the bin wall and an open position in which the upper portion of the door opening is substantially unobstructed by the inner door panel; and a cover member arranged to be supported on the exterior chute so as to be operable between a closed position spanning an open top end of the exterior chute between the side walls and an open position in which the open top end of the exterior chute is substantially unobstructed by the cover member.

Providing an exterior chute at the door assembly of a storage bin provides ready access for unloading the storage bin without the possibility of grain in the bin spilling outward onto the ground. Furthermore any conventional auger can be inserted into the exterior chute for unloading the bin without requiring any additional collection hoppers and the like to be supported adjacent the bin for collecting material spilling outwardly from the bin as in prior art configurations. The additional configuration of an inner door panel, a chute cover, and an outer door panel provides full access to the interior of the bin when desired, while also fully protecting the interior of the bin from the exterior elements when closed.

Preferably the bottom wall and the side walls of the exterior chute are arranged to be fixed in relation to the bin wall.

There may be provided a gusset member spanning generally laterally outwardly from each side wall which is arranged to be supported on the bin wall.

Preferably a top edge of the side walls of the exterior chute and the cover member supported therein in the closed position extend outwardly from the bin wall at a downward inclination.

The bottom wall of the exterior chute is preferably arranged to join the bottom edge of the door opening adjacent the bin floor.

The cover member is preferably pivotally supported at an inner end on the inner door panel such that the cover member is pivotal relative to the inner door panel between the open and closed positions of the cover member.

Preferably a latch member is arranged to retain the cover member relative to the inner door panel in an upright orientation along an outer side of the inner door panel in the open position of the cover member.

The inner door panel is preferably arranged to be pivotally coupled to the bin wall so as to be arranged for pivotal movement about an upright axis relative to the bin wall between the open and closed positions of the inner door panel.

The cover member is preferably arranged to be supported in an upright orientation along an outer side of the inner door panel in the open position of the cover member such that the cover member is pivotal together with the inner door panel between the open and closed positions of the inner door panel.

The exterior chute is preferably arranged to be narrower in a lateral direction between the side walls thereof than the upper portion of the door opening across which the inner door panel is arranged to span.

The bottom edge of the inner door panel may be arranged to be positioned adjacent a top edge of the side walls of the exterior chute such that the inner door panel is arranged to only span the upper portion of the door opening in the closed position of the inner door panel.

An outer door panel may be arranged to be supported on the bin wall so as to be operable between a closed position spanning the upper portion of the door opening between the top end of the door opening and the side walls of the exterior chute at an outer side of the bin wall and an open position in which the upper portion of the door opening is substantially unobstructed by outer door panel.

The outer door panel may be arranged to be pivotally coupled to the bin wall so as to be arranged for pivotal movement about an upright axis relative to the bin wall between the open and closed positions of the outer door panel.

The outer door panel is preferably arranged to overlap and retain the cover member in the closed position of the cover member when the outer door panel is in the closed position.

An edge flange is preferably arranged to be supported on the bin wall to extend outwardly therefrom about the upper portion of the door opening in which the edge flange extends outwardly from the top end of the door opening at an upward inclination. In this instance, the outer door panel preferably comprises a perimeter flange extending inwardly from the outer door panel so as to be arranged to overlap the edge flange at the top end of the door opening.

According to a second aspect of the present invention there is provided a method of unloading an agricultural storage bin comprising a circular bin floor, a cylindrical bin wall extending upwardly from the bin floor, and a door opening in the cylindrical bin wall, the method comprising:

providing a door assembly comprising:

an exterior chute arranged to communicate with a lower portion of the door opening, the exterior chute including a bottom wall arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute and an open position in which the upper portion of the door opening is substantially unobstructed by the inner door panel; and a cover member arranged to be supported on the exterior chute so as to be operable between a closed position spanning an open top end of the exterior chute between the side walls and an open position in which the open top end of the exterior chute is substantially unobstructed by the cover member;

displacing the cover member into the open position;

inserting an unloading auger into the interior of the storage bin through the open top end of the exterior chute;

operating the unloading auger to unload particulate material from the bin.

The unloading auger can be operated to unload particulate material from the bin until particulate material in the bin is substantially at a level of the inner door panel. At this point, the inner door panel can be opened so that the unloading auger can be inserted through the upper portion of the door opening, and further operated to unload particulate material from the bin below the inner door panel.

When there is provided an outer door panel supported on the bin wall, the outer door panel is preferably operable between a closed position spanning the upper portion of the door opening between the top end of the door opening and the side walls of the exterior chute at an outer side of the bin wall and an open position in which the upper portion of the door opening is substantially unobstructed by outer door panel.

The method may further include positioning the outer door panel to overlap and retain the cover member in the closed position of the cover member when the outer door panel is in the closed position and opening the outer door panel prior to opening the cover member.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
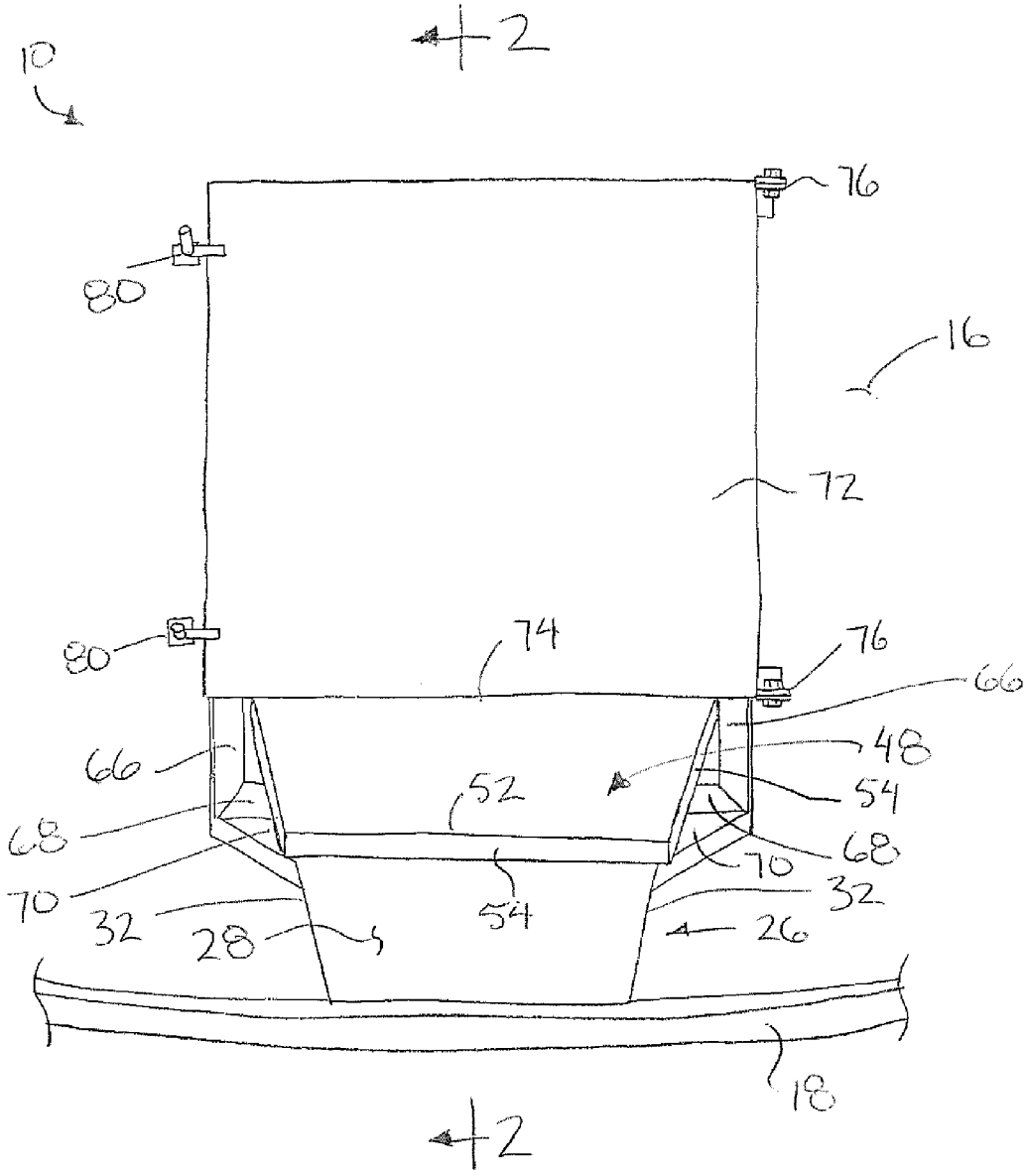
FIG. 1 is a front elevational view of the door assembly according to the present invention.

Referring to the accompanying figures there is illustrated a door assembly generally indicated by reference numeral 10. The door assembly 10 is particularly suited for use with an agricultural storage bin 12 of the type commonly used for storing grain therein.

The bin 12 typically comprises a flat bottom in the form of a circular floor panel 14 which supports a cylindrical bin wall 16 extending upwardly from the periphery thereof. A perimeter frame member 18 extends about the periphery of the cylindrical wall at the bottom end thereof with the floor panel 14 extending outward beyond the wall below the perimeter frame member 18 which provides additional structural support to the connection between the cylindrical wall and the floor panel. A door opening 20 is provided in the side wall to extend upwardly from a bottom end adjacent the floor panel 14.

The door assembly 10 can be arranged to be retrofit into an existing bin by reshaping the door opening of the bin or by forming a new opening in the bin wall. Alternatively the bin may be manufactured with a suitable door opening 20 therein about which the door assembly is supported. In each instance the door opening includes an upper portion 22 which is generally rectangular in shape and which is spaced above the bottom floor panel and a lower portion 24. The lower portion 24 of the door opening is joined with the upper portion to be continuous therewith such that the lower portion spans from the upper portion downwardly to a bottom edge adjacent the bottom floor panel 14 of the bin. The lower portion is narrower in a lateral direction between opposing upright side edges of the opening than the upper portion thereabove with the lower portion being centered in the lateral direction relative to the upper portion.

The door assembly 10 comprises an exterior chute 26 which is fixed onto the bin wall in communication with the lower portion of the door opening. The chute comprises a bottom wall 28 comprising a flat rectangular panel having a bottom edge which is joined to the bottom edge of the door opening to extend outward from the bin in a longitudinal direction of the chute in an upward inclination towards a top edge 30 of the bottom wall which is spaced outwardly from the bin wall and which is spaced above the bottom of the door opening near in elevation to a bottom edge of the upper portion of the opening.

The exterior chute 26 further comprises two side walls 32 which are vertically oriented so as to be parallel and spaced apart from one another at the opposing sides of the chute to extend in the longitudinal direction thereof outward from the bin wall. The side walls are joined to respective opposing side edges of the bottom wall and to the bin walls so as to be substantially triangular in shape. A reinforcing bar 33 is welded along the inner surface of the bin wall in a vertical orientation along each of the opposing upright side edges of the lower portion 24 of the door opening where the side walls of the chute are joined to the bin wall for added structural support about the lower portion of the door opening.

The side walls 32 join the bin wall along opposing sides of the lower portion of the door opening such that respective top edges of the two side walls are joined to the bin wall at a bottom end of the upper portion of the door opening. The top edges of the side wall and the top edge of the bottom wall lie in a common plane defining an exterior opening of the chute at an open top end between the two side walls. The plane of the exterior opening together with the top edges of the two side walls 32 are arranged to extend outward at a downward inclination from the bin wall to the top edge of the bottom wall such that the top edge of the bottom wall is lower in elevation than the bottom end of the upper portion of the door opening.

The upper portion of the door opening spans from the top of the side walls of the chute to the top end of the door opening. The greater width of the upper portion relative to the lower portion in the lateral direction between opposing upright side edges thereof defines two lower edges 34 of the bin wall. The lower edges 34 span laterally outward in a horizontal direction from opposing sides of the chute in a common plane with the top edges of the side walls 32 so as to define the bottom end of the upper portion of the door opening. Each lower edge 34 thus spans laterally outward from a respective one of the side walls 32 at the outer side of the lower portion of the door opening to the respective outer side of the wider upper portion of the door opening.

The door assembly further includes an inner door panel 36 which is supported on the inner side of the bin wall so as to span the upper portion of the door opening. The inner door panel 36 includes a main portion in the form of a flat sheet which spans a full height and width of the upper portion of the door opening in overlapping configuration with an inner surface of the opposing upright side edges of the door opening and the top edge of the door opening. The inner door panel also overlaps the lower edges 34 defining the bottom end of the upper portion. The bottom end 38 of the inner door panel terminates adjacent to the lower edges 34 such that the inner door panel only spans the upper portion of the door opening while the lower portion of the door opening remains open and in communication between the chute and the interior of the bin.

The inner door panel 36 further includes a perimeter flange 40 oriented perpendicularly to the flat sheet forming the main portion about a full perimeter of the main sheet such that the flange extends towards the bin wall about the periphery of the upper portion of the door opening for sealing engagement against the inner surface of the bin wall. Additional sealing material may be provided about the perimeter flange for sealing engagement between the perimeter flange of the inner door panel and the inner surface of the bin wall about the door opening.

The inner door panel 36 further comprises a lower flange member 41 which is mounted along the bottom edge of the door panel to span the full width of the door panel in the lateral direction. The lower flange member 41 extends downwardly at an inward inclination from the bottom of the door panel to project inwardly towards the interior of the bin. The bottom end of the lower flange member 41 is near in elevation to the free outer end of the chute. The flange member 41 thus serves to limit the height of grain flowing into the chute from the bin, while remaining sufficiently spaced above the bottom of the bin and the bottom of the lower portion of the door opening that a substantially horizontal flow of grain from the bin is not obstructed by the flange member. Additional brace members 43 in the form of triangular plates defining gussets are joined between the flange member 41 and the inner surface of the inner door panel 36 in a vertical orientation at spaced positions in the lateral direction to provide additional structural support to the flange member and bottom end of the inner door panel 36.

A pair of hinges 42 are spaced apart along one side of the door panel so as to pivotally couple the inner door panel to the inner surface of the bin wall at a pair of vertically spaced positions along one side of the upper portion of the door opening. The hinges 42 support the inner door panel 36 on the inner surface of the bin wall for pivotal movement relative to the bin wall between an open position in which the upper portion of the door opening is substantially unobstructed by the inner door panel and a closed position in which the inner door panel spans the upper portion of the door opening between the top end of the door opening and the top edges of the side walls of the exterior chute.

A latch member 44 is supported on the outer surface of the inner door panel adjacent one of the side edges opposite the hinges. The latch member 44 is arranged for mating engagement with a retainer flange 46 supported at the periphery of the door opening. The latch member 44 is pivotally supported on the door panel so as to be biased into a latched position hooked over top of the retainer flange 46. The latch is pivotal by actuation of a user to release the latch member from the retainer flange to permit the inner door panel to be pivoted from the closed position to the open position when the latch member is released. Engagement of the latch member retains the inner door panel in the closed position across the upper portion of the door opening.

A chute cover member 48 is provided for spanning the open top end of the exterior chute. The chute cover member comprises a main portion in the form of a flat rigid sheet of material which spans from an inner end 50 pivotally coupled to the outer side of the inner door panel 36 to an outer end 52 which overlaps the top edge of the bottom wall 28.

The cover member spans the full width of the inner door panel in the lateral direction at the inner end so as to be wider than the chute between the two side walls thereof and such that the main portion of the cover member overlaps both top edges of the side walls 32. The width of the cover member in the lateral direction becomes narrower from the inner end to the outer end 52 such that the outer end is near in width in the lateral direction to the width of the chute between the side walls. The chute cover member also has a length in the longitudinal direction which is greater than the open top end of the chute for overlapping the top edge of the bottom wall when the inner end is secured to the inner door panel.

A depending flange 54 is secured to the main portion of the cover member at the outer end and along both sides spanning between the inner end and outer end such that the depending flange 54 depends downwardly along an outer side of both side walls and the bottom wall of the exterior chute when the cover member spans the open top end of the chute. Hinges pivotally couple the inner end of the cover member to the inner door member such that the cover member is pivotal between a closed position enclosing the top end of the exterior chute and an open position in which the open top end of the exterior chute is substantially unobstructed by the cover member.

Figure 2:
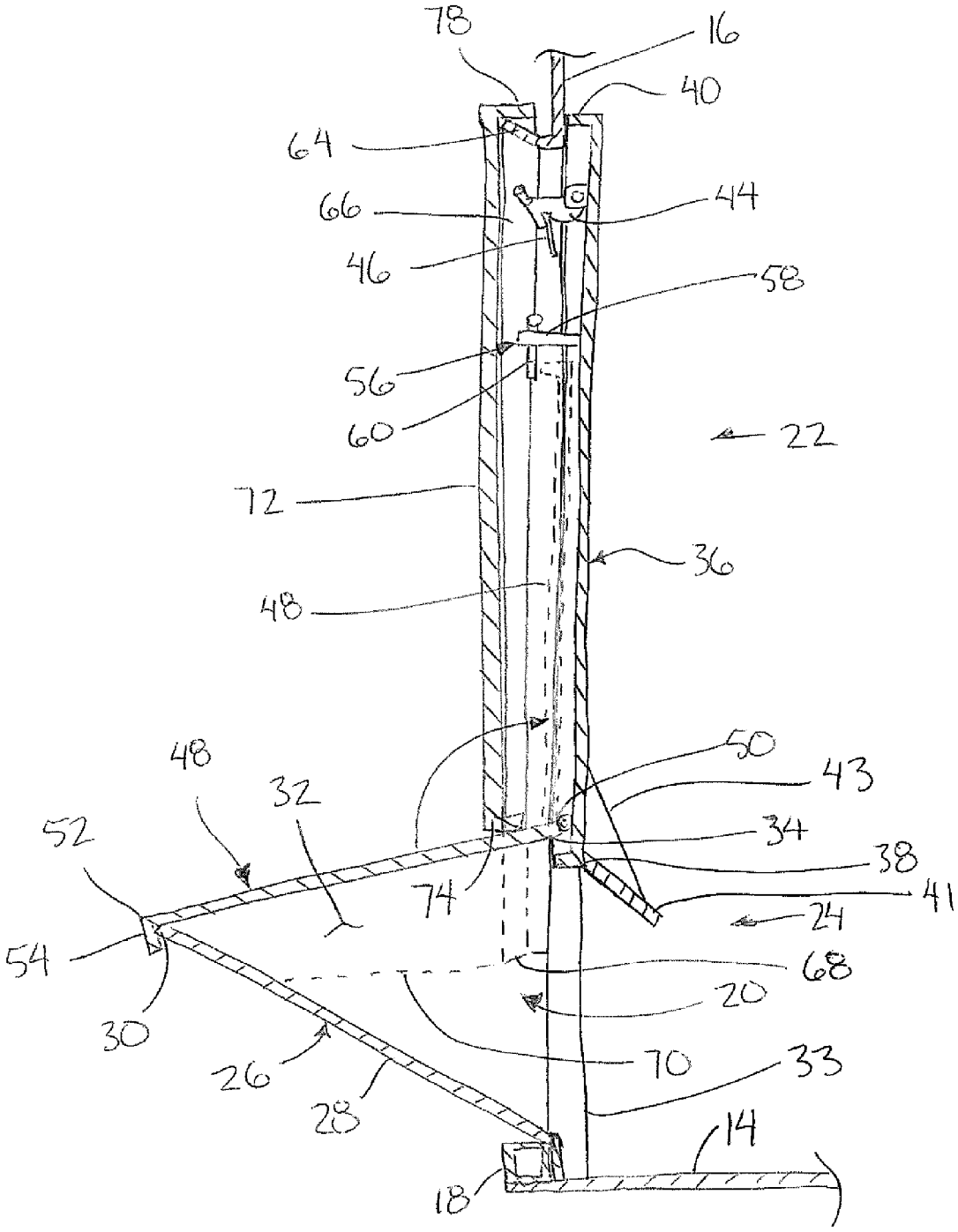
FIG. 2 is a sectional view along the line 2-2 of FIG. 1.
Figure 3:
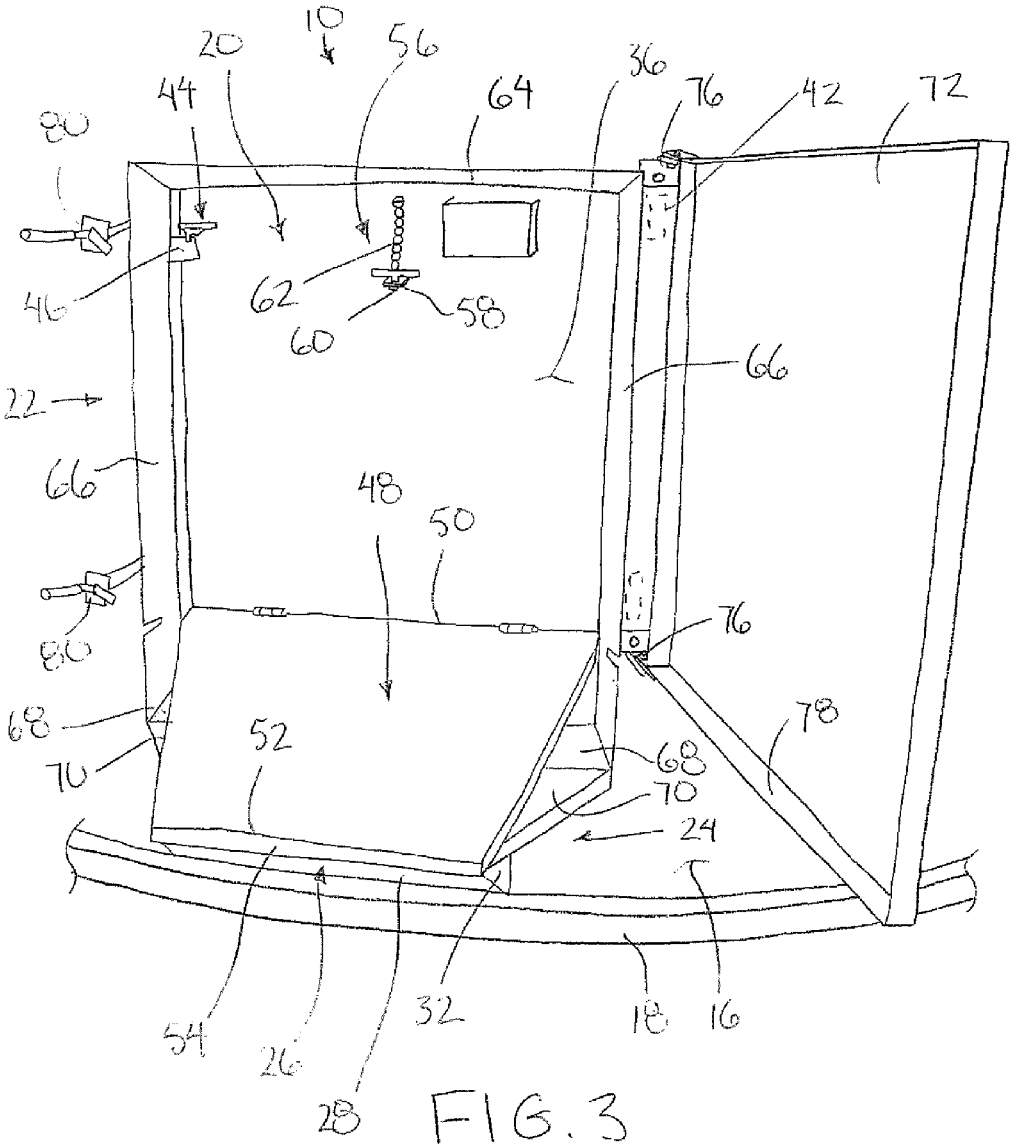
FIG. 3 is a perspective view of the door assembly in which only the outer door panel is in the open position.
Figure 4:
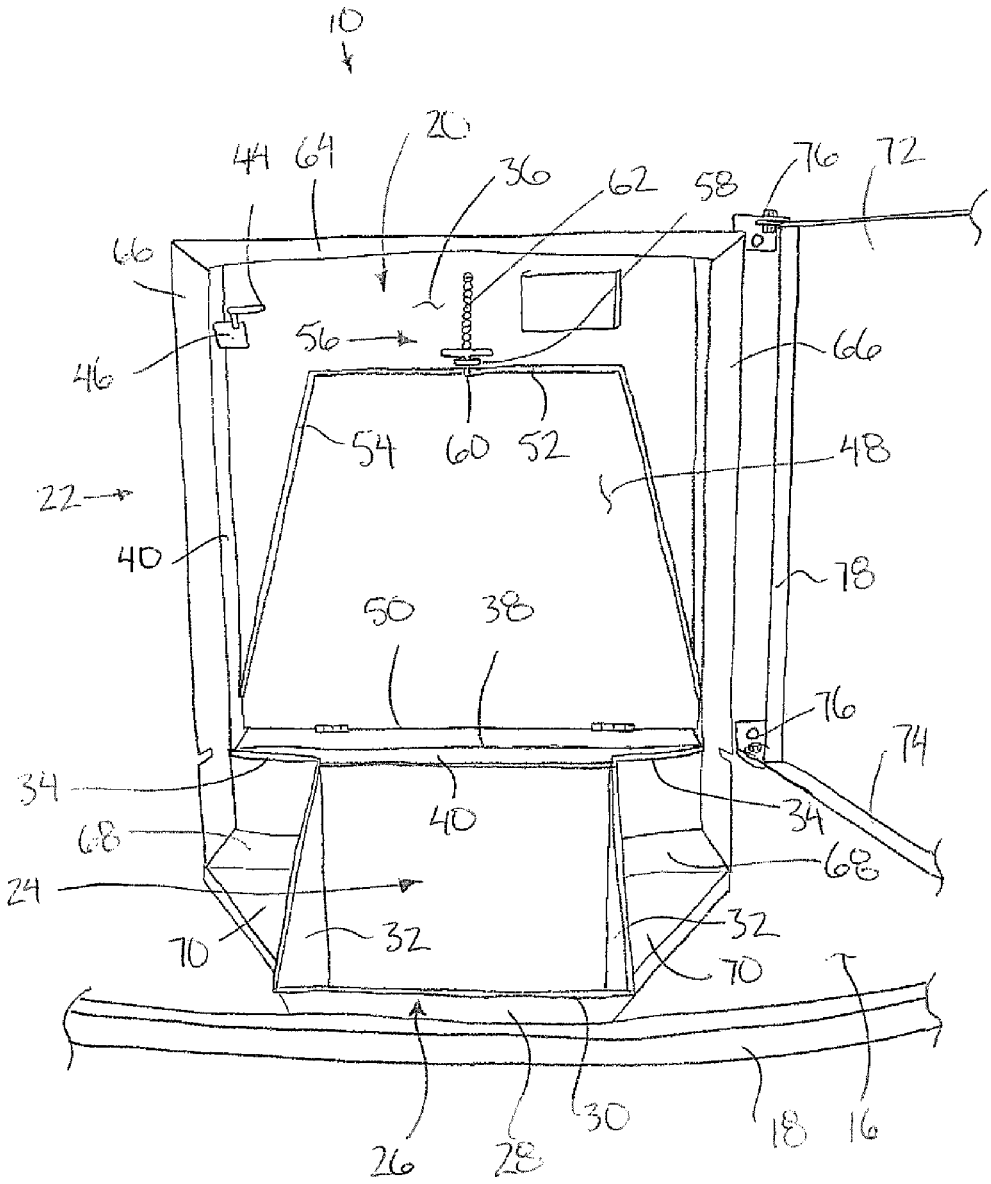
FIG. 4 is a perspective view of the door assembly in which both the outer door and the cover member of the chute are in the open position.
Figure 5:
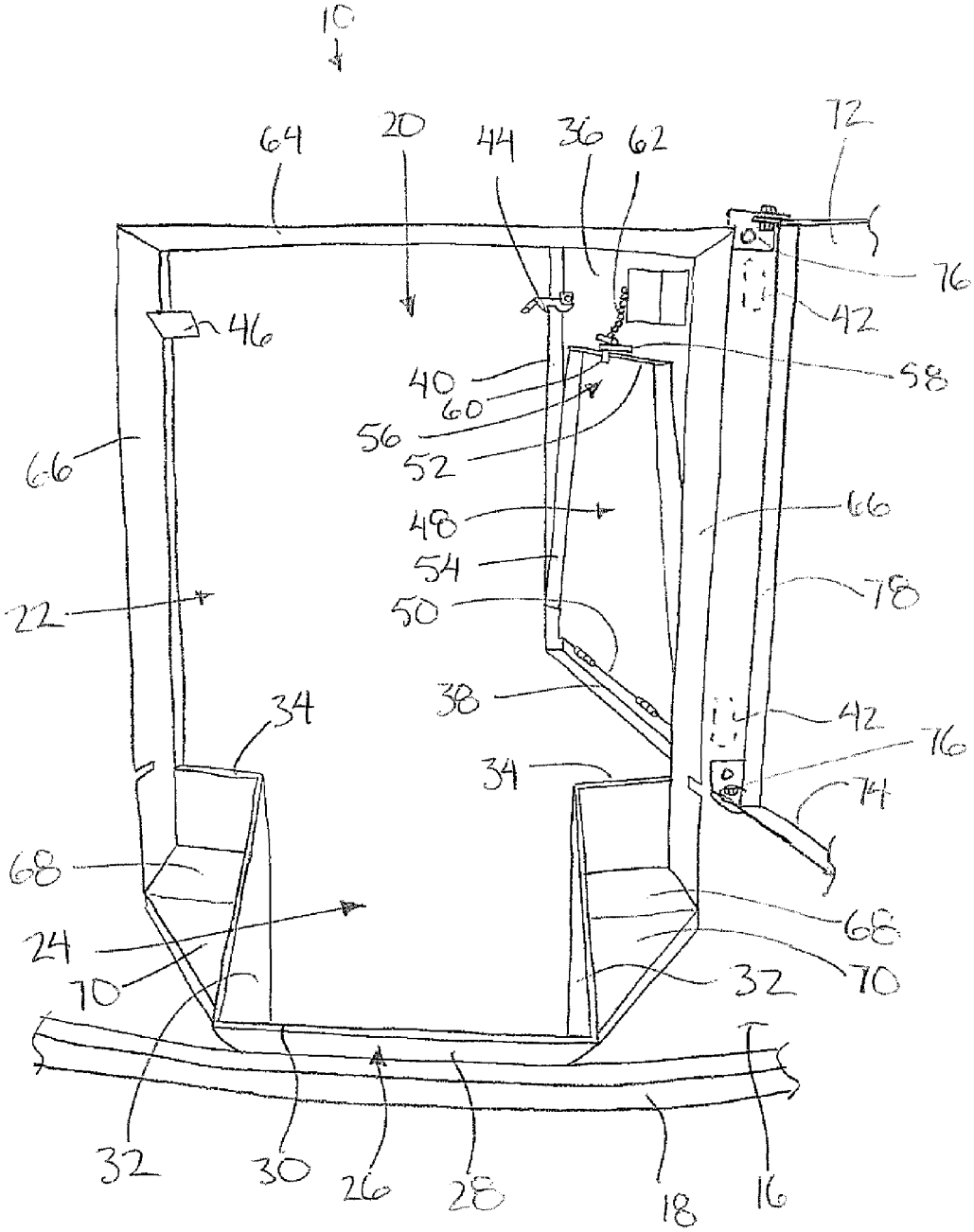
FIG. 5 is a perspective view of the door assembly in which the outer door panel, the chute cover member, and the inner door panel are all in the open position.
Figure 6:
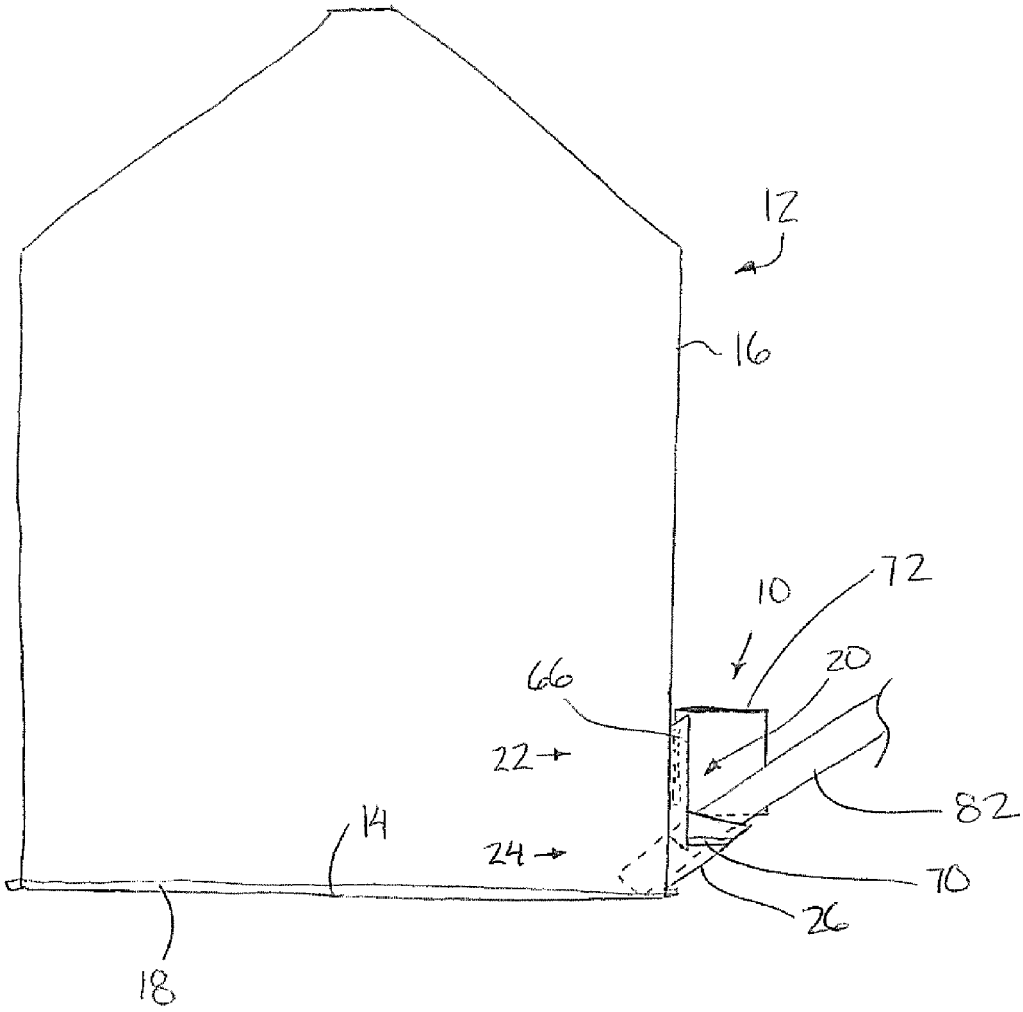
FIG. 6 is a schematic elevational view of the outer door panel and the chute cover member in the open position for receiving an agricultural conveyor through the chute for unloading the bin.

Length of the chute cover member in the longitudinal direction between inner and outer ends thereof is less than a height of the upper portion of the door opening. Accordingly, pivotal connection of the inner end of the cover member to the inner door panel adjacent the bottom end thereof permits the cover member to be positioned in a substantially vertical orientation in the open position thereof parallel and alongside the outer surface of the inner door panel. In the open position of the cover member shown in broken lines in FIG. 2, the cover member does not obstruct pivotal movement of the inner door panel between the open and closed positions thereof. The cover member is thus arranged to be supported in the open position on the inner door panel for movement therewith between the open and closed positions.

A latch member 56 is also supported on the outer surface of the inner door panel at a central location adjacent the top end thereof for selective engagement with the outer end of the cover member to retain the cover member coupled thereto in the open position. The latch member includes a supporting flange 58 projecting horizontally outward from the door panel with an aperture therein arranged to receive a locking pin 60 of the latch member therethrough. The locking pin is supported on a handle such that the locking pin extends downwardly through the aperture in the support flange 58 in overlapping configuration with the outward facing bottom side of the cover member in the open position. Slidably removing the locking pin 60 upwardly from the support flange releases the overlapping configuration of the locking pin with the cover member such that the cover member can be pivoted back downwardly into the closed position. When engaged, the latch member serves to retain the cover member in the open position supported on the inner door handle. A flexible chain 62 couples the handle of the locking pin to the door panel to prevent separation thereof while permitting free movement of a locking pin between engaged and disengaged positions thereof.

The door assembly 10 further comprises an edge flange fixed to the bin wall about the upper portion of the door opening to extend outward from the bin wall. The edge flange includes a top portion 64 extending outward from the top end of the door opening at an upward inclination, and two side portions 66 extending outward from the bin wall at diverging laterally outward inclinations away from one another at opposing sides of the upper portion of the door opening. The side portions extend downward from the top portion 64 to respective bottom ends which are spaced below the lower edges of the upper portion of the door opening.

The edge flange further comprises two lower portions 68 which span laterally between bottom ends of the two side portions 66 and the respective side walls of the chute at a location spaced below the top edges thereof. The two lower portions 68 extend outward from the bin wall at a downward inclination to respective outer edges lying in a common plane with the outer edges of the two side portions and the top portion.

The side walls of the exterior chute are provided with gusset members 70 for added structural support between the side walls and the bin wall at opposing sides of the lower portion of the door opening. Each gusset comprises a triangular member which is oriented to span generally horizontally at a slight downward inclination from the bin walls such that each gusset member is joined to a respective one of the side walls of the exterior chute and the respective lower portion 68 of the edge flange fixed relative to the bin wall.

The door assembly 10 further comprises an outer door panel 72 supported on the outer side of the bin wall so as to similarly span the upper portion of the door opening. The outer door panel includes a main portion in the form of a flat rigid sheet which is larger in dimension than the upper portion of the door opening for overlapping the bin wall along both opposing upright side edges of the upper portion of the door opening as well as overlapping the top end of the door opening. A bottom end 74 of the outer door panel 72 is ranged to meet the top side of the cover member in the closed position thereof.

A pair of hinges 76 coupled to the outer side of the bin wall at vertically spaced positions along one side of the upper portion of the door opening pivotally couple the outer door panel 72 to the bin wall such that the outer door panel is pivotal about a vertical axis between a closed position spanning the upper portion of the door opening between the top end of the door opening and the side walls of the exterior chute at an outer side of the bin wall and an open position in which the upper portion of the door opening is substantially unobstructed by the outer door panel. In the closed position of the outer door panel, the outer door panel overlaps and retains the cover member in a closed position due to the outer door panel overlapping the cover member at a location spaced outwardly from the inner end hinged to the inner door panel.

The outer door panel 72 further comprises a perimeter flange 78 supported on all four sides of the flat sheet forming the main portion such that the perimeter flange extends inward perpendicular to the main sheet towards the bin wall in overlapping configuration with the edge flange about the perimeter of the upper portion of the door opening. In particular, the perimeter flange overlaps the top portion 64 of the edge flange and an upper portion of the two side portions 66 above the chute cover member. Two notches are provided in the two side portions 66 in alignment with the top side of the cover member and the bottom end of the outer door panel such that the perimeter flange of the outer door panel is arranged to be received within the respective notches spanning across the chute cover member between the two opposing side portions of the edge flange in the closed position.

Two exterior latch members 80 are supported on the outer side of the bin wall at vertically spaced positions along one side of the door opening opposite the hinges of the outer door panel for selective engagement with the corresponding edge of the door panel 72 to retain the door panel in the closed position when the latches are engaged.

Unloading of an agricultural storage bin with the door assembly 10 supported thereon typically involves first opening the outer door panel followed by displacing the cover member into the open position where it is retained relative to the inner door panel by the latch member 44. An unloading auger 82 can then be inserted into the bin through the open top end of the chute and the lower portion of the door opening with which the chute communicates. In this position the auger can unload particulate material from the storage bin to a level corresponding approximately to the elevation of the bottom end of the inner door panel. At this point the inner door panel can be pivoted into the open position so that the auger 82 can be inserted further into the bin by extending the auger through the upper portion of the door opening above the exterior chute. The remainder of the bin can be unloaded with the inlet end of the auger being positioned in proximity to the center of the bin. A sweep auger may be employed as desired at the bottom of the bin without interference from the exterior chute of the door assembly.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A door assembly in combination with an agricultural storage bin including a circular bin floor, a cylindrical bin wall extending upwardly from the bin floor, and a door opening in the cylindrical bin wall having an upper portion and a lower portion, the door assembly comprising:

an exterior chute arranged to communicate with only the lower portion of the door opening, the exterior chute including a bottom wall arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel supported on the bin wall so as to be operable between a closed position spanning only the upper portion of the door opening which extends between the top end of the door opening and the lower portion of the door opening and an open position in which both the upper portion and the lower portion of the door opening are substantially unobstructed by the inner door panel;

the bottom end of the inner door panel terminating at a location spaced above the bottom end of the door opening in the closed position such that the lower portion of the door opening remains in communication between an interior of the bin and the exterior chute in the closed position of the inner door panel; and a cover member arranged to be supported on the exterior chute so as to be operable between a closed position spanning an open top end of the exterior chute between the side walls and an open position in which the open top end of the exterior chute is substantially unobstructed by the cover member.

2. The door assembly according to claim 1 wherein the bottom wall and the side walls of the exterior chute are arranged to be fixed in relation to the bin wall.

3. The door assembly according to claim 2 wherein there is provided a gusset member spanning generally laterally outwardly from each side wall and being arranged to be supported on the bin wall.

4. The door assembly according to claim 1 wherein a top edge of the side walls of the exterior chute and the cover member supported therein in the closed position extend outwardly from the bin wall at a downward inclination.

5. The door assembly according to claim 1 wherein the bottom wall of the exterior chute is arranged to join the bottom edge of the door opening adjacent the bin floor.

6. The door assembly according to claim 1 wherein the cover member is pivotally supported at an inner end on the inner door panel such that the cover member is pivotal relative to the inner door panel between the open and closed positions of the cover member.

7. The door assembly according to claim 6 wherein there is provided a latch member arranged to retain the cover member relative to the inner door panel in an upright orientation along an outer side of the inner door panel in the open position of the cover member.

8. The door assembly according to claim 1 wherein the inner door panel is arranged to be pivotally coupled to the bin wall so as to be arranged for pivotal movement about an upright axis relative to the bin wall inwardly into the bin from the closed position of the inner door panel against an inner side of the bin wall towards the open position.

9. The door assembly according to claim 8 wherein the cover member is arranged to be supported in an upright orientation along an outer side of the inner door panel in the open position of the cover member such that the cover member is pivotal together with the inner door panel between the open and closed positions of the inner door panel.

10. The door assembly according to claim 1 wherein the exterior chute is arranged to be narrower in a lateral direction between the side walls thereof than the upper portion of the door opening across which the inner door panel is arranged to span.

11. The door assembly according to claim 1 wherein a bottom edge of the inner door panel is arranged to be positioned adjacent a top edge of the side walls of the exterior chute in the closed position of the inner door panel.

12. The door assembly according to claim 1 wherein there is provided an outer door panel arranged to be supported on the bin wall so as to be operable between a closed position spanning the upper portion of the door opening between the top end of the door opening and the side walls of the exterior chute at an outer side of the bin wall and an open position in which the upper portion of the door opening is substantially unobstructed by outer door panel.

13. The door assembly according to claim 12 wherein the outer door panel is arranged to be pivotally coupled to the bin wall so as to be arranged for pivotal movement about an upright axis relative to the bin wall between the open and closed positions of the outer door panel.

14. The door assembly according to claim 12 wherein the outer door panel is arranged to overlap and retain the cover member in the closed position of the cover member when the outer door panel is in the closed position.

15. The door assembly according to claim 12 wherein there is provided an edge flange arranged to be supported on the bin wall to extend outwardly therefrom about the upper portion of the door opening, the edge flange extending outwardly from the top end of the door opening at an upward inclination, and wherein the outer door panel comprises a perimeter flange extending inwardly from the outer door panel so as to be arranged to overlap the edge flange at the top end of the door opening.

16. A door assembly for an agricultural storage bin including a circular bin floor, a cylindrical bin wall extending upwardly from the bin floor, and a door opening in the cylindrical bin wall, the door assembly comprising:

an exterior chute arranged to communicate with a lower portion of the door opening, the exterior chute including a bottom wail arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute at an inner side of the bin wall and an open position in which the upper portion of the door opening is substantially unobstructed by the inner door panel; and a cover member arranged to be supported on the exterior chute so as to be operable between a closed position spanning an open top end of the exterior chute between the side walls and an open position in which the open top end of the exterior chute is substantially unobstructed by the cover member;

wherein the cover member is pivotally supported at an inner end on the inner door panel such that the cover member is pivotal relative to the inner door panel between the open and closed positions of the cover member.

17. A door assembly for an agricultural storage bin including a circular bin floor, a cylindrical bin wall extending upwardly from the bin floor, and a door opening in the cylindrical bin wall, the door assembly comprising:

an exterior chute arranged to communicate with a lower portion of the door opening, the exterior chute including a bottom wall arranged to extend outwardly at an upward inclination from a bottom edge of the door opening and a pair of side walls arranged to span from respective sides of the bottom wall to the bin wail at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute at an inner side of the bin wall and an open position in which the upper portion of the door opening is substantially unobstructed by the inner door panel; and a cover member arranged to be supported on the exterior chute so as to be operable between a closed position spanning an open top end of the exterior chute between the side walls and an open position in which the open top end of the exterior chute is substantially unobstructed by the cover member;

wherein the inner door panel is arranged to be pivotally coupled to the bin wall so as to be arranged for pivotal movement about an upright axis relative to the bin wall between the open and closed positions of the inner door panel; and wherein the cover member is arranged to be supported in an upright orientation along an outer side of the inner door panel in the open position of the cover member such that the cover member is pivotal together with the inner door panel between the open and closed positions of the inner door panel.

18. A door assembly for an agricultural storage bin including a circular bin floor, a cylindrical bin wall extending upwardly from the bin floor, and a door opening in the cylindrical bin wall, the door assembly comprising:

an exterior chute arranged to communicate with a lower portion of the door opening, the exterior chute including a bottom wall arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute at an inner side of the bin wall and an open position in which the upper portion of the door opening is substantially unobstructed by the inner door panel;

a cover member arranged to be supported on the exterior chute so as to be operable between a closed position spanning an open top end of the exterior chute between the side walls and an open position in which the open top end of the exterior chute is substantially unobstructed by the cover member; and an outer door panel arranged to be supported on the bin wall so as to be operable between a closed position spanning the upper portion of the door opening between the top end of the door opening and the side walls of the exterior chute at an outer side of the bin wall and an open position in which the upper portion of the door opening is substantially unobstructed by outer door panel;

wherein the outer door panel is arranged to overlap and retain the cover member in the closed position of the cover member when the outer door panel is in the closed position.

19. A door assembly for an agricultural storage bin including a circular bin floor, a cylindrical bin wall extending upwardly from the bin floor, and a door opening in the cylindrical bin wall, the door assembly comprising:

an exterior chute arranged to communicate with a lower portion of the door opening, the exterior chute including a bottom wall arranged to extend outwardly at an upward inclination from a bottom edge of the door opening and a pair of side walls arranged to span from respective sides of the bottom wall to the bin wall at a location spaced below a top end of the door opening adjacent the lower portion of the door opening;

an inner door panel arranged to be supported on the bin wall so as to be operable between a closed position spanning an upper portion of the door opening between the top end of the door opening and the side walls of the exterior chute at an inner side of the bin wall and an open position in which the upper portion of the door opening is substantially unobstructed by the inner door panel;

a cover member arranged to be supported on the exterior chute so as to be operable between a closed position spanning an open top end of the exterior chute between the side walls and an open position in which the open top end of the exterior chute is substantially unobstructed by the cover member;

an outer door panel arranged to be supported on the bin wall so as to be operable between a closed position spanning the upper portion of the door opening between the top end of the door opening and the side walls of the exterior chute at an outer side of the bin wall and an open position in which the upper portion of the door opening is substantially unobstructed by outer door panel; and an edge flange arranged to be supported on the bin wall to extend outwardly therefrom about the upper portion of the door opening, the edge flange extending outwardly from the top end of the door opening at an upward inclination;

wherein the outer door panel comprises a perimeter flange extending inwardly from the outer door panel so as to be arranged to overlap the edge flange at the top end of the door opening.

* * * * *